US009050238B2

(12) United States Patent
Nour et al.

(10) Patent No.: US 9,050,238 B2
(45) Date of Patent: Jun. 9, 2015

(54) PULSATILE AND NON-INVASIVE DEVICE FOR CIRCULATORY AND HAEMODYNAMIC ASSISTANCE

(75) Inventors: Sayed Nour, Chaville (FR); Pierre Chastanier, Paris (FR)

(73) Assignee: Cardio Innovative Systems-CIS (FR)

( * ) Notice: Subject to any disclaimer, the term of this patent is extended or adjusted under 35 U.S.C. 154(b) by 1029 days.

(21) Appl. No.: 13/139,898

(22) PCT Filed: Dec. 16, 2009

(86) PCT No.: PCT/EP2009/067352

§ 371 (c)(1),
(2), (4) Date: Jun. 15, 2011

(87) PCT Pub. No.: WO2010/070018

PCT Pub. Date: Jun. 24, 2010

(65) Prior Publication Data

US 2011/0257463 A1 Oct. 20, 2011

(30) Foreign Application Priority Data

Dec. 16, 2008 (FR) ..... 08 07077
Jul. 23, 2009 (FR) ..... 09 55168

(51) Int. Cl.
*A61H 9/00* (2006.01)

(52) U.S. Cl.
CPC ..... *A61H 9/0078* (2013.01); *A61H 2201/165* (2013.01)

(58) Field of Classification Search
CPC ..... A61H 9/0078; A61H 2201/165
USPC ..... 601/9, 10, 11, 23, 33, 34, 35, 84, 86, 601/88, 90, 96, 98, 104, 105, 148–152; 602/13, 17, 19, 23, 27
See application file for complete search history.

(56) References Cited

U.S. PATENT DOCUMENTS

| | | | | |
|---|---|---|---|---|
| 6,126,683 | A * | 10/2000 | Momtaheni | 602/13 |
| 2002/0198480 | A1 * | 12/2002 | Ravikumar | 602/13 |
| 2006/0287621 | A1 * | 12/2006 | Atkinson et al. | 601/151 |
| 2007/0282233 | A1 * | 12/2007 | Meyer et al. | 602/23 |

FOREIGN PATENT DOCUMENTS

| | | |
|---|---|---|
| EP | 1 652 557 A1 | 5/2006 |
| GB | 2 433 034 A | 6/2007 |
| WO | 03/053780 A1 | 7/2003 |

OTHER PUBLICATIONS

International Search Report for Appln. No. PCT/EP2009/067352 mailed Feb. 26, 2010.

* cited by examiner

*Primary Examiner* — Quang D Thanh
(74) *Attorney, Agent, or Firm* — Carter, DeLuca, Farrell & Schmidt, LLP

(57) ABSTRACT

The present invention relates to a non-invasive pulsatile circulatory assistance device encouraging the circulation of a volume of blood in a subject's body, wherein the device includes a flexible multilayer structure for applying against at least a portion of the subject's body, the structure having a flexible inner layer beside the subject's body and a more rigid outer layer; means for pulsating connected to the multilayer structure in such a manner that the assembly having the structure plus the pulsation means is leaktight, and wherein the pulsation means are adapted to create pulsations between the inner and outer layers by means of a fluid referred to as a "pulsation" fluid, each of the pulsations propagating progressively in the venous return direction along the portion of the subject's body when the structure is placed on the portion of the subject's body.

12 Claims, 3 Drawing Sheets

PULSATILE AND NON-INVASIVE DEVICE FOR CIRCULATORY AND HAEMODYNAMIC ASSISTANCE

FIELD OF THE INVENTION

The present invention relates to a novel device for circulatory assistance.

More particularly, the invention relates to a non-invasive circulatory and hemodynamic assistance device.

BACKGROUND OF THE INVENTION

The circulatory system comprises a closed hydraulic circuit that is under pressure and that is internally lined with endothelial cells. The endothelium is subjected continuously to tangential shear stress that is essential to maintaining its physiological function: vascular tonus by synthesizing nitrogen monoxide, blood coagulation, inflammatory response, combating artherosclerosis, immune system, angiogenesis, and apoptosis.

Any pathological alteration of the endothelial function will give rise to malfunction of the system, with consequences that can sometimes be dramatic.

At present, there is no circulatory assistance system in existence that seeks to conserve or to improve this endothelial function.

Cardiac assistance systems are known that are used for replacing heart activity in full or in part during a surgical operation or in order to restore said activity when the heart has stopped or is too weak. Such systems are mostly invasive systems, requiring either a tool to be inserted into a subject's body, said tool subsequently being used to create pulsations, or a blood sampling in the subject and treating the blood sample in a voluminous machine outside the body, followed by injecting the blood back into the subject's body. Under all circumstances, present systems are expensive and complicated to implement, since they require action to be taken by specialists. Furthermore, those systems can only be implemented on dedicated sites such as medical sites, and under the supervision of qualified people.

Furthermore, existing systems having a complex architecture, which makes such systems expensive to manufacture.

Furthermore, present systems serve for taking general action on the subject's body, generally on the subject's heart, and they are not suitable for acting on different portions of a subject's body, such as for example, the legs, the hands, the face, etc.

Thus, at present, no circulatory assistance system exists, that is non-invasive, and that is intended to preserve the endothelial function or to improve said function when it has deteriorated.

OBJECTS AND SUMMARY OF THE INVENTION

An object of the present invention is to overcome the above-mentioned drawbacks.

Another object of the present invention is to propose a non-invasive circulatory assistance device for preserving the endothelial function or for improving said function when it has deteriorated.

Yet another object of the present invention is to propose a non-invasive circulatory assistance device that is of low cost, of simple architecture, and that is simple to use.

Another object of the invention is to propose a circulatory and hemodynamic assistance device that is capable of being used on any portion of a subject's body, such as for example the hands, the face, the legs, the feet, etc.

Finally, another object of the invention is to propose a non-invasive circulatory assistance system that is more effective than cardiac assistance systems.

The present invention enables these objects to be achieved by means of a non-invasive pulsatile circulatory assistance device facilitating the circulation of a volume of blood in the body of a subject, wherein the device comprises:

a flexible multilayer structure for applying against at least a portion of said subject's body, said structure comprising a flexible inner layer beside said subject's body and a more rigid outer layer; and means for pulsating connected to said multilayer structure in such a manner that the assembly comprising the structure plus the pulsation means is leaktight, and wherein said pulsation means are adapted to create pulsations between said inner and outer layers by means of a fluid referred to as a "pulsation" fluid, each of said pulsations propagating progressively in the venous return direction along said portion of said subject's body when said structure is placed on said portion of said subject's body.

The device of the invention assists blood circulation in non-invasive manner by applying pulsations to a portion of a subject's body via a multilayer structure.

The device of the invention is simple to use, one only has to apply the multilayer structure to a portion of the body, and then to use the pulsation means to create pulsations that propagate along said portion of the body.

There is no need for the subject to go to a dedicated site in order to use the device of the invention. The device of the invention may be used at home, in a car, while walking or running, while on a flight in an airplane, etc.

The multilayer structure may be applied to any portion of the body, with the exception of sensitive portions, such as, for example, the genitals or the eyes, without requiring the modifications that are provided in pulsatile accessories such as underwear with male sex accessories (or pulsatile eye bandages). Thus, the subject may apply the device of the invention to any portion of the body such as, for example: the face, an arm, a hand, a foot, a leg, the neck, etc. so as to achieve circulatory assistance dedicated to that portion of the body. The device of the invention enables blood circulatory assistance to be targeted to a particular portion of the body by acting directly on said portion of the body.

The device of the invention is also easy to manufacture and has low manufacturing cost.

THEORY

In order to better understand disturbances to the endothelium in the circulatory system, there follows a description of the angiongensis-apoptosis interdependency phenomenon with reference to the hemodynamic theory based on flow and rate hemodynamic theory in children and in adults, as discovered by the inventors.

In the arterial segment, the heart and peristaltic forces drive blood flow in pulsatile manner with a physiological pressure difference (between systole and diastole).

In contrast, in the veins and the lymphatic vessels, blood and lymph flow continuously under drive from circulatory forces of different kinds provided by:

breathing movements (diaphragm, intercostal muscles); muscular circulatory pumping; gravity; atmospheric pressure; contact receptors; viscosity; right heart intervention (valves, atrium, ventricle, lung pressure, venous capacitance, pericardium).

Drainage of the veins is thus conditioned directly by the forces that allow blood to return to the right atrioventricular cavities at the time of diastolic filling.

Good filling of the right heart (or pre-loading) is essential for harmonious operation of the entire cardiovascular system.

Increasing pre-loading improves muscular oxygenation of the right ventricle. This depends more on diastolic filling than on its own myocardiac coronary networks. This gives rise to an increase in its contractile force, thereby improving the shear stresses that appear in pulmonary circulation. These stresses give rise to a drop in vascular resistance as a result of the excretion of the nitrogen monoxide (NO) they induce in the pulmonary endothelium, and this drop in pulmonary resistance (or post-loading) in turn improves the overall cardiac flow rate.

This explains why nitro compounds that are so effective in treating myocardial infarction when it is the left ventricle that is affected, can on the contrary, in the event of right ventricle ischemia, run the risk of causing the subject to die because the filling of this ventricle decreases after administration specifically because of the vasodilation action of nitrides.

Another cogent example is the acrobatic sitting position taken up spontaneously by a child suffering from Fallot's tetralogy. During an attack, because of the increase in pulmonary resistance, the child goes blue. By taking up that sitting position, the blue child artificially increases vascular resistance on the left side, thereby having the effect of deflecting a greater pulsatile volume into the pulmonary arterial circuit by means of interventricular communication (IVC).

The shear stresses as increased in this way force the pulmonary endothelium to produce more NO, thereby immediately increasing the flow and the rate in the pulmonary arterial tree.

As a general rule, any increase in resistance in a hydraulic circuit leads to a malfunction of the injection pump. That explains why increasing vascular resistance (post-loading) of the left side gives rise to malfunction of the left ventricle, with any improvement being possible only by lowering said post-loading (vasodilation action of nitrides in the event of left infarction).

The right heart in a Fallot's attack thus paradoxically gives rise to an increase in the left post-loading in order to reduce its own post-loading! That means that it has no hesitation in temporarily endangering the left heart in order to improve its own hemodynamics, and only subsequently improves once more the hemodynamics of the left heart (Table 1: The Bossy Right Heart)!

At present, in the event of failure of the right ventricle, the conventional therapeutic scheme consists in:

a) increasing the volume of blood by intravenous perfusion; and b) increasing the heart beat frequency (atrial kick) by chronotropic means or by a pacemaker (electrical stimulation).

In both circumstances that increases shear stresses (volume and rate) obtained by non-physiological methods, and that is not without side effects.

TABLE 1

Right heart domination of the left heart via pulmonary resistance

| | Right heart | Left heart |
|---|---|---|
| Low systemic resistance | Bad hemodynamics[1] | Good hemodynamics |
| High systemic resistance | Good hemodynamics[2] | Bad hemodynamics |
| Low pulmonary resistance | Good hemodynamics | Good hemodynamics |
| High pulmonary resistance | Bad hemodynamics | Bad hemodynamics |

1 = Nitrides and right ventricle infarction

2 = Fallot's attack

Contrary to the generally-accepted concept, we consider that the right heart dominates the development and the hemodynamics of the left heart, beginning in antenatal life. During intrauterine life, although the right ventricle (RV) receives $2/3^{rds}$ of the body blood volume, the walls of the veins and of the right ventricle retain low remodeling compared with the systemic arteries because of the existence of physiological shunts (ductus venosus, arterial duct, oval foramen).

After birth and as a result of the physiological shunts closing, each ventricle receives the same volume of blood, and it is ejected at the same frequency. On being subjected to identical rheological conditions, the right ventricle has a myocardiac mass that is only $1/6^{th}$ that of the left ventricle (LV).

This can be explained as a result of two major factors:

A. Cardiac: In addition to the characteristics already described in the literature (spherical morphology of the right ventricular cavity, distribution of fibers, contractility axis, etc.), we stress the major role played by the trabecular muscle that lines the inside of the anterior face of the right atrium and most of the ventricular cavity (excluding the septum and the infundibulum). We emphasize the importance of this concept in our new classification of the right heart subdivided into five zones.

B. Extracardiac: Under the control of the accessory forces specified below.

In particular, we consider that the breathing pump possesses a direct effect on physiological control of the circulatory system.

Extravascular Physiological Shear Stresses that Influence the Endothelial Function A. The respiratory pump "master" of the cardio-endothelial system:

Like an accordion, the inflation/deflation movements of the lungs give rise to external shear stresses on the pulmonary vessels. Their impressive effects start after birth, on taking the first breath, giving rise to an immediate drop in pulmonary resistance and triggering closure of shunts, beginning with the valve of the oval foramen and then continuing, over the next few days, with the ductus venosus and the arterial duct.

In our clinical experience, the failure of Glenn's operation on children younger than two years old is associated with the respiratory pump not having the capacity to deliver sufficient shear stresses to provide the necessary venous drainage, with this being as a result of insufficient development of the rib cage.

B. Fluctuations/propagations of external pulsatile waves giving rise to endothelial reactions:

Similarly, a difference between malign tumors and benign tumors may stem from the presence or absence of a capsule that plays a protective role against the propagation of pulsatile waves coming from neighboring organs. This may explain the poorer prognosis for cancers of movable organs (stomach, lungs) and for tumors of richly vascularized organs such as the brain, compared with that of cancers of organs that are more stationary such as the thyroid or the prostate.

We explain this by the fact that any external stimulation of the endothelial function accelerates angiogenesis and thus tumor growth.

Another example: congenital malformations are usually associated with a decrease during the initial months of pregnancy in the amniotic liquid that isolates the fetus from pulsatile waves propagated by neighboring maternal organs.

(Centre Hospitalo-Universitaire, Strasbourg, France: C. Stoll et al., Study of 224 cases of oligohydramnios and congenital malformations in a series of 225,669 consecutive births, Community Genet 1998; 1:71-77.)

The principle on which the present invention is based serves to subdivide the right heart into five morphological zones (ventricular mass and thickness of vascular walls) depending on response to shear stresses applied to the endothelial walls. Sayed Nour et al., "The forgotten driving forces in right heart failure", Asiatic Ann Cardiovasc. Thorac. Surg. (in press).

These five zones are as follows:

Zone 1: represented by the venous system that is remodeled little because of the absence of rhythmic forces. The low-pressure flow of blood in this zone is under the influence of accessory circulatory forces (Table 1).

Zone 2: represented by the atrioventricular cavity where the venous return blood flow begins to be animated (rate and pressure), thereby giving rise to moderate remodeling. The trabecular muscle here acts as a natural break, attenuating the shear stresses exerted on the wall, thereby enabling it to make do with a thickness that is $1/6^{th}$ that of the left ventricle (which does not have a large trabecular zone). In this zone, hemodynamics depend on the diastolic filling (pre-loading) that is essential for feeding the right ventricular muscle, in particular in its trabecular portion.

Zone 3: this is the interventricular septum that maintains normal morphology to the left and to the right, associated with it being vascularized by the interseptal arteries. The hemodynamics of this zone depends indirectly on those of the left ventricle (vascularization in common) and directly on the shear stresses acting to the right in order to lower the pulmonary post-loading (which gives rise to a consecutive hemodynamic improvement on the left).

Zone 4: represented by the infundibulum with a very large amount of remodeling resulting from the magnitude of the shear stresses arising from the first interseptal artery. The hemodynamics in this zone thus depend on the shear stresses (volume and rate) and on the extra pressure from the first interseptal artery.

Zone 5: represented by the arterial pulmonary tree, a zone that is little altered, with a diameter-thickness percentage of the wall that is almost identical to that of large veins. The hemodynamics in this zone depend on vascular resistance (lower post-loading), in turn associated with shear stresses (particularly with rate since the tree manages to lower its arterial pressure as a result of its compliance, even though it receives the same volume of blood as the aorta).

The disturbances of the accessory forces may give rise to endothelial malfunction. We mention a few examples, in application of our classification as given above, so as to make the phenomenon more understandable:

In Zone 1, which is strongly dependent on these accessory forces, it can be seen that interfering with them gives rise to cardiovascular and circulatory troubles that are almost identical in astronauts and in professional divers. In spite of the great difference in pressure observed in those two circumstances (low pressure for astronauts, very high pressure for divers), the troubles that are observed are associated with the failure of the venous drainage pump (high venous capacitance by lack of gravity in space and by being compressed under water).

The same applies to the early development of wrinkles in divers, and to severe facial edema at high altitude (Siobhan Gill, Neil M. Walker, "Severe facial edema at high altitude", Journal of Travel Medicine, Vol. 200815, Issue 2, pp. 130-132, International Society of Travel Medicine).

Apart from those extreme conditions, edema of the face around the eyes (swollen eyelids) is more apparent in the morning after a long night's sleep (sometimes associated with headaches), and disappears progressively as activity is taken up.

This lymphatic congestion demonstrates that the effect of reducing gravity on the venous return of the face, giving rise to an accumulation of toxic substances (inflammatory syndrome, free radicals, slowing down of cavernous circulation).

However, in children, in spite of vascularization and a face area that are greater than in adults, the effect of gravity during long periods of sleep remains minimal.

Parkland's formula known as the "rule of 9s" as applied to people with third-degree burns demonstrates the magnitude of the body area of the head compared with the remainder of the body, being 18% in children compared with 9% in adults.

Good sleep encourages anabolism (repair and regeneration) of the angiogenesis-apoptosis process that depends on shear stresses associated with good venous drainage. In children or newborns, the heart rate is very high and sometimes twice that of adults (even when asleep).

As a result, these shear forces are essential for enabling natural acceleration of growth. With such a flow, such a rate, and such a facial surface area, children always have a smooth face without the slightest sign of swelling, with satin skin even after very long periods of lying supine.

The morphological difference between adults and children thus plays an important role in explaining this phenomenon.

Furthermore, in order to provide good venous drainage, avoiding the side effects caused by gravity during sleep, two other elements are associated with the action of the accessory forces of circulation:

crying, which represents a major exercise of the muscular pump in the face, thereby preventing venous stasis; and an almost non-existent neck (web neck) making venous drainage even more dependent on the respiratory pump.

Hemodynamic effects in the other zones, Zone 2 to Zone 4, are also disturbed by a reduction of venous returns in Zone 1. Direct cardio-pathogenic effects (ischemia of the myocardium or heart malformation) can thus give rise to major hemodynamic troubles.

Maintaining good hemodynamics in Zone 5, which is a key zone, constitutes a condition for achieving good overall operation of the circulatory system. High resistance in Zone 5 (post-loading) may give rise to retrograde hemodynamic troubles with systemic hemodynamic pressure reduction. Acute or chronic pulmonary hypertension syndromes depend on the level of nitrogen monoxide excretion and on vascular remodeling, in other words on shear forces.

To summarize, whereas under physiological conditions, circulation accessory forces ensure venous and lymphatic drainage, endothelial malfunction gives rise to venous and lymphatic stasis that are responsible for circulatory and hemodynamic troubles: signs of tiredness (troubles of the immune system and inflammatory response), early aging (troubles of angiogenesis-apoptosis). It is from these observations that the invention of novel circulatory assistance devices stems.

SUMMARY

1. In the event of failure of the heart pump: We recommend applying shear frequencies that are higher than the heart rate in Zone 5 (pulmonary artery), enabling to create a vortex close to the arterial wall (rotational flow with energy dissipation under the effect of viscosity—Bernoulli's principle) without increasing pressure (Newton) so as to avoid the compliance or stretchability of the pulmonary artery (terminating in Eisenmenger syndrome) or giving rise to a disturbance in the long term in the monocellular arrangement of the alveolar endothelium.

On the contrary, if use is made of an external pulsation system acting remotely on Zone 1, as in our model of pulsatile trousers, the shear frequencies must imperatively be slower than the heart rate (not more than 50%) in order to avoid excess feed by means of such external compression, which would increase shear forces, applied to a ventricular and pulmonary circuit that is already overloaded.

2. In the event of circulatory risks in a normal heart (astronauts, divers) the frequencies used for the pulsatile suit should be synchronized with the diastolic phase, except in the event of respiratory troubles or tachycardia.

Concerning peripheral circulation (masks, socks, boots, . . . ) the frequencies may be faster than the heart rate without any danger.

3. Finally, in the event of heart failure, the shear stresses generated by our pulsatile devices are adapted to the needs of the endothelial system, depending on the portion of the circuit that is concerned.

APPLICATIONS

The inventors have discovered that the device of the invention may be used in a multitude of applications, all associated with the endothelial function.

The inventors have discovered, for example, that aging is in reality the consequence of a disturbance to the endothelial function implementing a process of angiogenesis-apoptosis interdependency, having as early signs wrinkles or gray hair that appear specifically in those portions of the body that are the most vascularized (face and head). This aging is a natural phenomenon associated with the progressive slowing down of the process whereby dead cells (programmed cell death or apoptosis) are replaced by angiogenesis, and it is particularly accelerated each time secondary factors (infection, ischemic syndrome, traumatisms, X-ray or UV radiation, degenerative syndrome) affect the endothelial function (inflammatory syndrome, immune system, vasoconstriction).

According to an advantageous feature of the device of the invention, the pulsation means may be adapted to generate pulsation at a rate that is a function of:

data relating to heart rate;

data relating to breathing rate;

data relating to the subject's state of health; and/or data relating to the body portion on which said multilayer structure is applied.

The device of the invention may comprise means for measuring the heart rate and means for measuring the breathing rate.

The device of the invention may comprise means for modifying, adjusting, and selecting the rate at which pulsations are generated by the pulsation means.

The pulsation rate may be determined as a function of the subject's needs. Animal testings undertaken by the inventors make it possible to distinguish between the following situations for regulating the pulsation rate as a function of the state of the subject and as a function of the zone of the body on which the multilayer structure of the device of the invention is applied:

in the event of failure of the subject's heart pump:

in Zone 5, the pulmonary artery zone, the theory described in the earlier "Microth" patent and publication as confirmed by experimentations show that it is necessary to apply a shear frequency that is faster than the heart rate, anabling to create a vortex close to the artery wall (rotational flow with energy dissipation under the effect of viscosity—Bernoulli's principle) without increasing pressure (Newton) in order to avoid the compliance or stretchability of the pulmonary artery (terminating by Eisenmenger syndrome) or long-term disturbance of the monocellular arrangement of the alveolar endothelium;

if the device is used to act on Zone 1, i.e. on the venous system, e.g. in the form of pulsatile trousers, the shear frequency must necessarily be slower than the heart rate, being about 50% of the heart rate, so as to avoid external compression that increases shear forces overfeeding a ventricular and pulmonary circuit that is already overloaded;

for circulatory troubles of a normal heart, e.g. microvascular angina, diabetics, or hypertensives (without cardiac side effects), side effects of the menopause, astronauts or divers:

the frequency used in Zone 5 needs to be synchronized with the diastolic phase, except for breathing troubles or tachycardia;

on other peripheral zones, pulsatile masks, socks, or boots, the frequency may be faster than the heart rate without any danger; and with normal subjects having no cardiac or circulatory illness, e.g. sports men and women: even if athletes are capable of adapting to their venous return (in accordance with the Frank-Starling law of the heart): 1) it is always recommended to monitor diastolic synchronization if circumstances make that possible, as in a gym or a massage; 2) with users such as those warming up before matches or jogging, regular inspections envisaged by heart specialists in order to set out the rules to be applied by the sports man or woman.

To summarize, it is essential to maintain regular medical contact in order to take the appropriate choices as hemodynamics improve: in the event of heart failure, the frequency should be adapted to the needs of the endothelial system depending on the zone in question without synchronization, unlike other applications where there is no heart disease.

In a particular embodiment, the device of the invention may comprise a module comprising firstly selector means enabling a user to select data relative to the user's physical state such as age, height, weight, state of the heart, etc., means for measuring heart rate and breathing rate, and means for calculating the pulsation rate as a function of one or more of these data items depending on one or more predetermined relationships.

Advantageously, the inner layer may comprise, at least on a portion thereof, a cavity between a microporous wall for putting into contact with the subject's skin and a wall beside the outer layer, said cavity being arranged to receive and/or convey a substance for application to said subject's skin through said microporous wall.

Thus, the device of the invention enables one or more biological or cosmetic substances to be applied, and enables them to diffuse over the underlying portion of the body in uniform manner.

Under such circumstances, the multilayer structure of the device of the invention may include an opening enabling the cavity to be filled with a substance. While the device of the invention is in use, this opening may either be connected to a supply of substance via connection means, or else it may be closed in sealed manner by closure means, said cavity being prefilled and then serving also as a supply of substance.

In a particular embodiment, the multilayer structure may include an admission opening for admitting a pulsation fluid coming from the means for pulsating between the inner and outer layers, and the means for guiding the pulsations, comprise a gelatinous and/or granular fluid between said outer and inner layers, performing a progressive propagation of each of the pulsations in the venous return direction along the portion of the body on which the multilayer structure is applied.

According to a paticularity of the invention, the gelatinous or granular fluid may be contained in an intermediate layer between the outer layer and the inner layer.

In a first version of the pulsation means, the pulsation means may comprise:

a pneumatic reservoir;

means for compressing said pneumatic reservoir in rhythmic manner; and a leaktight connector connecting said pneumatic reservoir to the flexible multilayer structure.

The compression means may be mechanical, and may be actuated directly by the subject or by an optionally portable external source of energy.

In a second version of the pulsation means, the pulsation means may comprises:

a prefilled pneumatic reservoir; and a leaktight connector connecting said pneumatic reservoir to the flexible multilayer structure;

the assembly comprising the reservoir, the connector, and the structure constituting a closed circuit for the pulsation fluid; and said pneumatic reservoir being arranged in such a manner as to be compressed and decompressed by a force exerted by said subject.

This exerted force may be exerted by the subject directly by clamping and unclamping the fists when the reservoir is placed in the user's hand.

The force may also be exerted by pressure/suction created by at least one shoe worn by the subject striking a surface, e.g. while walking or running. Under such circumstances, the prefilled pneumatic reservoir is placed under or in a shoe of the subject so that when the subject exerts pressure by bearing on a foot, the reservoir is emptied of the fluid it contains and the fluid is injected into the multilayer structure, thereby generating a pulsation, and when the subject releases pressure on the foot, e.g. by raising the foot, the fluid injected into the multilayer structure is returned into the pneumatic reservoir.

In a particular embodiment, the pneumatic reservoir, the connector, and the flexible multilayer structure may constitute a one-piece unit, when for example the multilayer structure constitutes a boot for being worn by the subject.

The flexible multilayer structure may also comprise a hood for placing over at least a portion of the subject's face.

In addition, the flexible multilayer structure may comprise a pair of trousers.

Advantageously, the flexible multilayer structure may comprise a jacket.

The flexible multilayer structure may also comprise one or more gloves or glove portions for applying to at least a portion of the subject's hand and/or wrist.

Furthermore, the flexible multilayer structure may comprise a boot, a shoe, or a sock. Under such circumstances, the pulsation means may be incorporated in the sole of the boot, shoe, or sock, such that the pulsations are created by the subject walking or running, with the pressures being created by the foot bearing against the ground giving rise to progressive inflation of the multilayer structure, and with raising the foot giving rise to optionally progressive deflation of the multilayer structure.

The multilayer structure may comprise:

pulsatile underwear elements such as corsets, stockings, . . . , etc. e.g. used for treating cellulitis, or troubles with sexual relations in man and woman;

pulsatile rings for applying to the lower or upper limbs of diabetics and hypertensives; and eye accessories, e.g. in the form of an eye bandage for treating wrinkles.

In another aspect of the invention, there is provided a non-invasive pulsatile circulatory assistance assembly covering several portions of a subject's body, said assembly comprising at least a plurality of devices for each of said body portions, each of the devices being independent.

According to yet another aspect of the invention, there is provided a non-invasive pulsatile circulatory assistance assembly covering a plurality of portions of a subject's body, the assembly comprising:

for each of said portions, a flexible multilayer structure for application on said portion of said subject's body, said structure comprising a flexible inner layer beside said subject's body and a more rigid outer layer; and means for pulsating common to said pulsatile structures, said means for pulsating being connected in leaktight manner to each of said multilayer structures such that, wherein said pulsation means are adapted to create pulsations between said inner and outer layers of each of said structures by means of a "pulsation" fluid, each of said pulsations in each of said portions propagating progressively in the venous return direction in said portion of the subject's body when said structures are in place on the subject's body.

BRIEF DESCRIPTION OF THE DRAWINGS

Other advantages and characteristics of the invention appear on examining the detailed description of a non-limiting embodiment and the accompanying drawings, in which.

DETAILED DESCRIPTION

The device of the invention produces harmonious and progressive rhythmic movements over all or part of the organism by bringing blood back from the extremities towards the heart at the moment of diastole. It produces non-aggressive compression forces for reducing the veno-lymphatic capacitance usually stagnating in subcutaneous tissue, circulation in the liver and the spleen, or in the face.

Several examples of the device of the invention are described below.

In all of the examples that are described:

the propagation axes of the "pulsatile waves" are determined so as to conserve the natural and physiological directions for draining veins and lymph vessels;

the pulsatile forces may be produced by a system that is pneumatic, electronic, hydraulic, or even independent, using the force of the subject; and the back portions that are normally not inflatable in order to protect the spine from trauma, may be modified in versions that are designed to perform body massage while conserving essential safety features.

Figure 1:
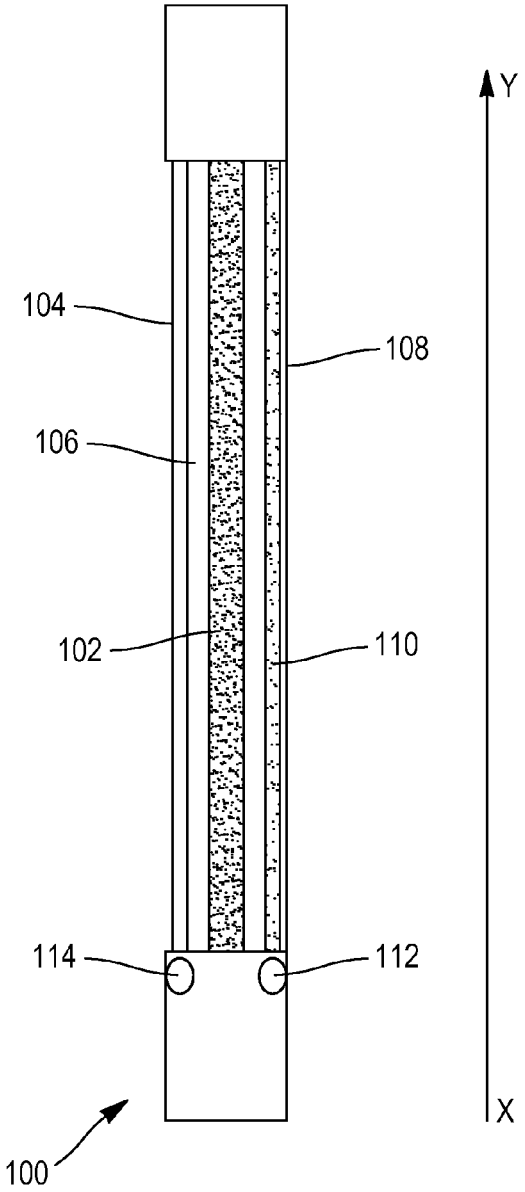
FIG. 1 is a schematic representation of an example of a multilayer structure implemented in the device of the invention.

FIG. 1 is a schematic representation of an example of a multilayer structure implemented in the device of the invention.

The multilayer structure 100 shown in FIG. 1 comprises:

an inner layer 102 made of an elastic material, e.g. neoprene, polyurethane, latex, . . . ;

a rigid outer layer 104 made of a rigid material for guiding the propagation of compression waves towards the inside of the body; and an intermediate layer 106 containing a gelatinous fluid enabling a pulsatile pressure wave to propagate progressively towards the heart in the natural and physiological direction for draining veins and lymph vessels in the body portion on which said structure is applied. In the description below, it is assumed that the natural and physiological direction for draining the veins and the lymphatic vessels is the direction XY as shown in FIG. 1.

The multilayer structure 100 also includes an additional layer 108 comprising a space 110 of biocompatible material and including a microporous wall in contact with the body and suitable for being filled with a biocompatible and/or biological fluid via a connector 112. This microporous portion is in direct contact with the skin. During pulsations, the substance contained in this layer 108 is applied to the subject's body by passing through the microporous portion.

The outer layer 104 is connected in leaktight manner to pulsation means (see FIG. 2) for creating pulsations in the multilayer structure 100 via a connection port 114.

In order to cause pulsations to propagate progressively along the body portion on which the multilayer structure 100 is applied, the intermediate layer 106 includes a substance of varying consistency, that is gelatinous, granular, etc., and distributes each of the pulsations progressively along said multilayer structure in the XY direction.

Figure 2:
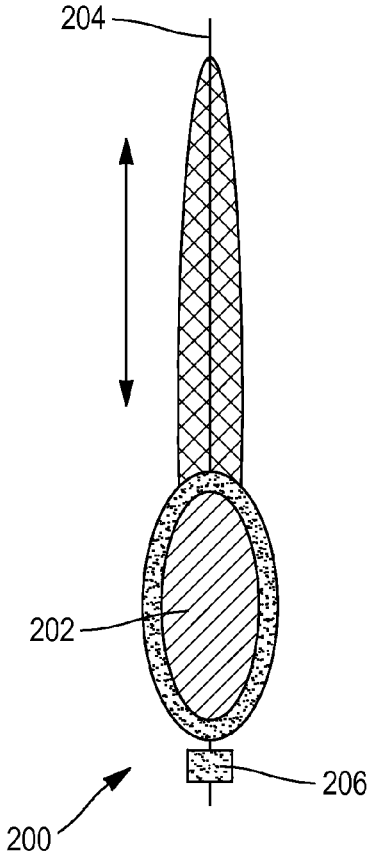
FIG. 2 is a schematic representation of a console suitable for creating pulses in the multilayer structure of FIG. 1.

FIG. 2 is a schematic representation of an example of a console enabling pulsations to be created in the multilayer structure 100 of FIG. 1.

The console 200 shown in FIG. 2 comprises:

a pneumatic reservoir 202 filled with a fluid, e.g. a fluid that is inert, gaseous, or liquid, such as water; and a leaktight connector 204 connecting the pneumatic reservoir 202 to the flexible multilayer structure 100.

The leaktight connector 204 is connected directly or indirectly to the connection port 114 of the multilayer structure 100.

The pneumatic reservoir 202 may be prefilled. The pneumatic reservoir has a port 206 serving to add, remove, or replace inert fluid.

The pneumatic reservoir 202 may be compressed directly by the subject. The reservoir may be compressed by the subject squeezing it in the hand.

In an embodiment, the pneumatic reservoir 202 may be placed under a shoe or under the subject's foot. Pulsations are then created merely by the subject walking or running.

The console 200 may also include one or more means for compressing the pneumatic reservoir 202 in rhythmic manner. The compression means may be actuated and controlled manually or by means of a control module.

Figure 3:
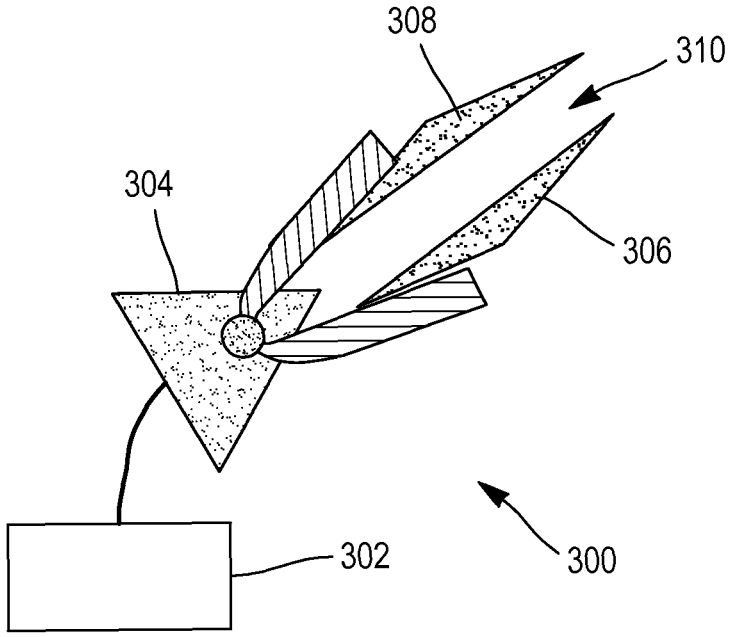
FIG. 3 is a schematic representation of a compression module serving to create pulsations in combination with the console of FIG. 2.

FIG. 3 is a schematic representation of an example of a compression module 300 for compressing the pneumatic reservoir 202. The compression module 300 has a battery 302 powering a motor unit 304 connected to two plates 306 and 308 that form between them a space 310 for receiving the pneumatic reservoir 202. When the motor unit is actuated, the plates 306 and 308 move towards each other and apart from each other in rhythmic manner. Each approach of the plates 306 and 308 creates pressure and each separation creates suction.

Figure 4:
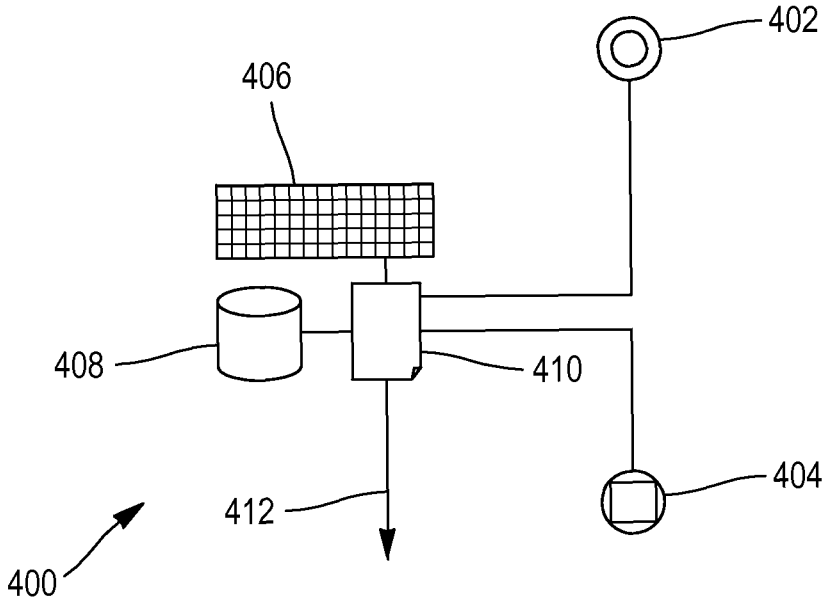
FIG. 4 is a schematic representation of a module for determining a pulsation rate.

FIG. 4 is a schematic representation of a module for determining the pulsation frequency.

The module 400 for determining pulsation frequency comprises a heart rate detector 402, a breathing rate detector 404, and data input means for receiving data relating to:

the state of health of the subject, such as for example good health, risk of right heart failure, left heart failure, etc.;

the corpulence of the subject, such as, for example: height, weight, age, etc.; and the portion of the body on which the multilayer structure 100 is applied.

In the example shown in FIG. 400, these input means comprise a touch screen 406.

The module 400 may also include a database 408 connected to a computer program 410 that responds to the inputted data to determine a pulsation rate that is appropriate and that issues a control signal 412 for controlling the compression module 300.

There follows a description of various pulsatile elements of the invention.

Figure 5:
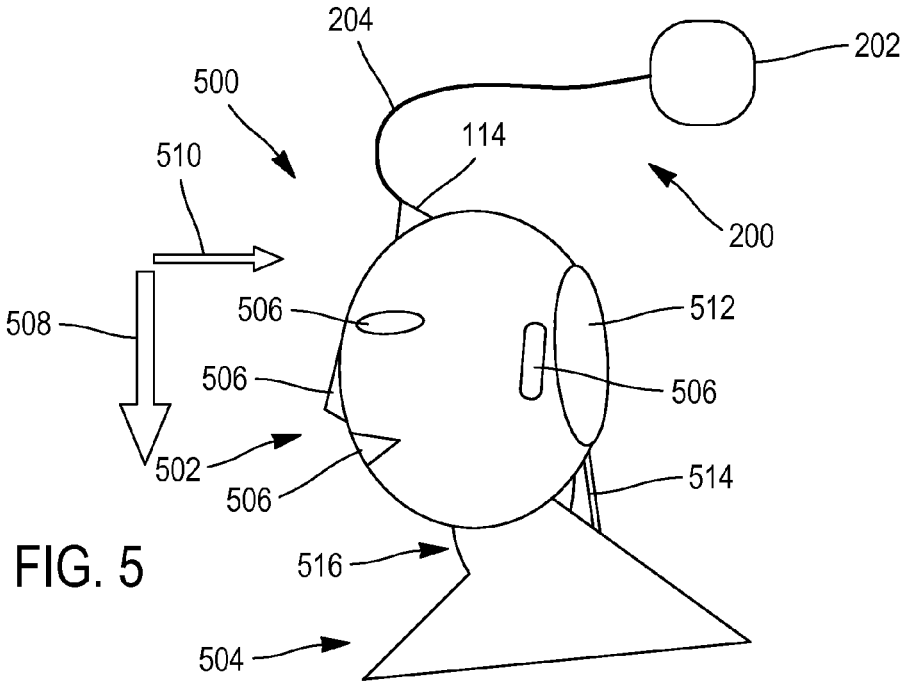
FIG. 5 is a schematic representation of a pulsatile hood of the invention.

FIG. 5 is a schematic representation of a pulsatile hood 500 of the invention. The pulsatile hood 500 comprises a face mask 502 and a collar 504 made with the multilayer structure 100 as shown in FIG. 1.

The mask 502 has decompression holes 506 in the eyes, the mouth, the nose, and the ears regions. A connector 114 connects the pulsatile console 200 to one or more connection ports 114 formed in the outer layer of the face mask 502. Each pulsation delivered propagates progressively from the connection port 114 downwards and towards the heart along a main propagation axis represented by arrow 508. A horizontal axis represented by arrow 510 represents the path of pulsatile waves towards the cavernous circuit.

The eye portion 512 of the mask 502 is inflatable little or not at all. The back portion 514 on the neck 516 is arranged to perform pulsatile massage of the neck in complete safety.

The hood 500 provides non-invasive pulsatile circulatory assistance for treating veno-lymphatic stasis of the face and the neck. It is worn pressed against the face and the neck. Its two components, the mask 502 and the collar 504 operate in regular and rhythmic synchronization and in harmony with the heart-breathing rate.

The hood also has the following functions:

a main function: restoring and repairing the side effects of endothelial malfunction by applying shear stresses synchronized with diastole, reducing lymphatic and venous congestion;

a secondary function: improving the hemodynamics of the blood circulation of the cavernous system acting on headaches or loss of memory, etc.; and improving cutaneous circulation by nitrogen monoxide increasing and accelerating absorption and penetration of existing cosmetics such as skin care and anti-aging substances.

The inner layer of the mask 502 may be modeled on a biological mask or it may be made of biocompatible material, being adapted to the shape of the face and the neck. The inside surface may be microporous for diffusing fluids of a cosmetic nature towards the skin, with or without varying the temperature of the substances or fluids used, depending on indications.

Hemodynamic improvement occurs in two stages:

immediately by reducing the stagnant venous capacitance synchronously with the diastolic phase. The increase in the rhythmic diastolic volume improves ventricular contractility, lowers pulmonary post-loading, and improves the overall heart flow rate; and in the long term, improving the endothelial function by increasing shear stresses:

reducing post-loading by causing NO to be excreted; and stimulating the angiogenesis-myocardiac cardiogenesis process in the corresponding ischemic territory.

Figure 6:
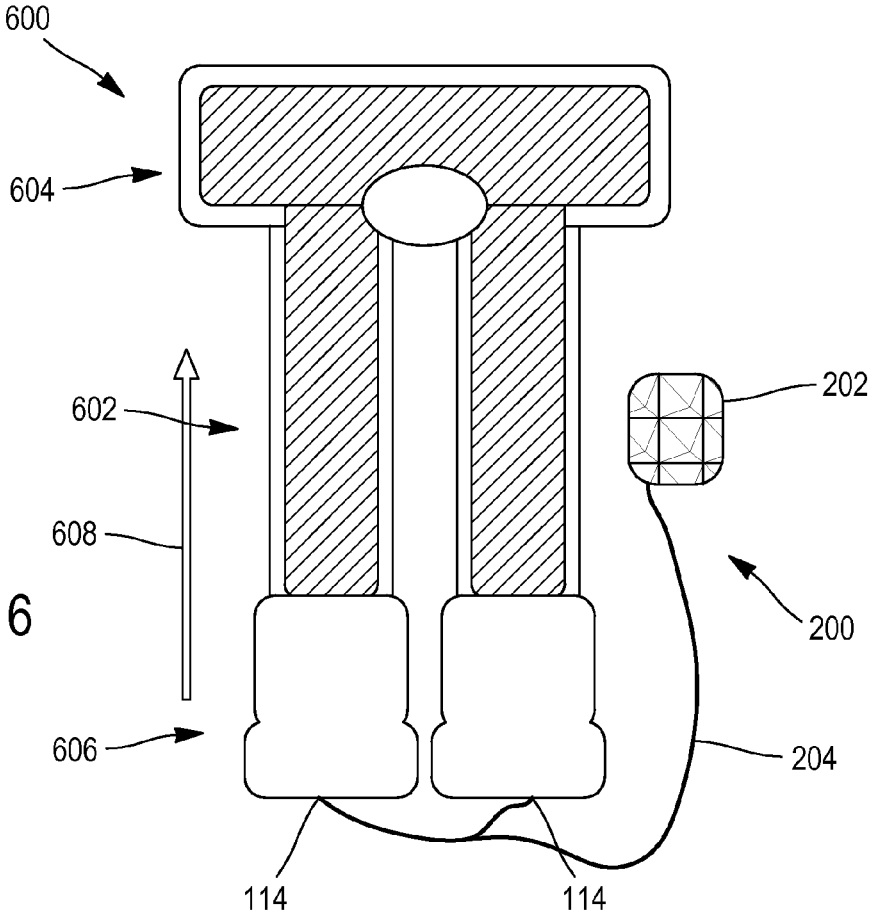
FIG. 6 is a schematic representation of a pair of pulsatile trousers of the invention.

FIG. 6 is a schematic representation of a pair of pulsatile trousers 600 of the invention.

The pulsatile trousers 600 comprise leg portions 602, a belt portion 604, and boot portions 606. In this version of the invention, the trousers 600 do not have a microporous layer.

Pulsatile waves start from the boot portions 606 coming from the pulsatile console 200. Each pulsation then propagates towards the heart along an axis represented by arrow 608.

In addition to the system described above for the pulsatile hood, this system provides utilization that is both restorative and prophylactic:

restorative concerning endothelial malfunction by virtue of shear stresses encouraging angiogenesis in paraplegics or patients presenting a fracture of the femur; and prophylactic by preventing coagulation troubles associated with endothelial malfunction in sensitive people, e.g. while remaining stationary for a long period of time, e.g. on long-haul flights, lying prone for a prolonged period after an operation, and periods of being kept stationary during accidents.

In a particular version, the pulsatile trousers may have a first layer in contact with the skin through personal garments.

Modifications of the back portion may be envisaged for massaging the spine.

Communications between the various portions (trousers, belts, legs) are coordinated and synchronized with diastole so as to avoid any tourniquet effect in the inguinal fold.

In the same manner it is possible to envisage a pulsatile jacket, pulsatile undergarments, pulsatile boots, pulsatile gloves, and indeed a complete pulsatile suit.

A complete pulsatile suit may also be obtained by assembling a hood, a jacket, pulsatile trousers, pulsatile gloves, and pulsatile shoes. Under such circumstances, in a first embodiment, each pulsatile assembly may be associated with dedicated pulsation means. In a second embodiment, single pulsation means may be used for all of the pulsation assemblies making up the pulsatile suit.

The pulsatile suit may be used for massage purposes. Such a suit considerably improves the fatigue associated with endothelial malfunction as a result of troubles concerning apoptosis-angiogenesis equilibrium as a result of an inflammatory syndrome, a deficit of the immune system, or a disruption of nitrogen monoxide excretion.

In a modified version, the pulsatile suit may include an additional layer in contact with the skin, thus facilitating the delivery of cosmetic substances (for skin care, tonicity, etc.).

The propagation of pulsatile pulses is synchronized from a plurality of distal origins, such as pulsatile boots or pulsatile gloves.

Each pulsatile assembly may be used separately as a function of the subject's needs.

In a closed circuit, the pulsatile suit may be used by divers, astronauts, sports men and women, and athletes enabling performance to be improved immediately in physiological manner by secretion of catecholamines, while also providing long-term improvement in the development of muscle mass by angiogenesis.

Sports men and women may provide their own pulsatile forces using gloves and clenching the fists, or boots while jogging.

The pulsatile suit may provide assistance to each zone concerned depending on the subject's hemodynamic and biophysical needs, namely:

Zone 1 depending on accessory circulatory forces: the pulsatile suit improves hemodynamics by delivering massage waves that reduce the venous capacitance and encourage blood to return to the heart at the moment of diastole. The invention may be of benefit for the following two groups of indications:

pathological indications: right ventricular failure, chronic pulmonary hypertension, astronauts, divers, varicose veins, paraplegics, orthostatic syndrome; and comfort indications: massage parlors, fitness, gym, long-distance air travel;

Zones 2 to 4 depending on diastolic filling and rate: the combination may enable subjects suffering from severe heart pathologies to maintain this physiological function in the long term; and Zone 5: pulmonary arterial tree: the suit lowers resistances and improves the endothelial function.

Each pulsatile device of the invention is a non-invasive circulatory assistance device that serves to reduce progressively the stagnant veno-lymphatic capacitance. By increasing the pre-loading, the device of the invention improves cardiac contractility, thereby lowering post-loading and giving rise to an overall hemodynamic improvement. In the long term, the shear stresses produced by the pulsatile device of the invention serve to restore and preserve the endothelial function. It transforms the supply of blood (64% venous capacitance) and the endothelial mass into a natural emergency exit in the event of hemodynamic and circulatory failure. This more physiological and low-cost method is capable of reducing morbidity and mortality and is applicable to children, adults, and also animals.

Naturally, the invention is not limited to the above-described examples that show particular, non-limiting embodiments.

What is claimed is:

1. A non-invasive pulsatile circulatory assistance device assembly facilitating a circulation of a volume of blood in a subject's body, wherein the device comprises:

a flexible multilayer structure for applying against at least a portion of said subject's body, said structure comprising a flexible inner layer beside said subject's body and a more rigid outer layer, wherein the inner layer comprises, on at least one portion thereof, a cavity between a microporous wall for putting into contact with the subject's skin and a wall beside the outer layer, said cavity being arranged to receive or convey a substance for application to said subject's skin through said microporous wall; and means for pulsating connected to said multilayer structure in such a manner that the assembly comprising the structure plus the means for pulsating is leaktight, and creating pulsation waves between said inner and outer layers by means of a pulsation fluid, said multilayer structure including means for guiding each of said pulsations progressively in the venous return direction towards an inside space of said subject's body along said portion of said subject's body when said structure is placed on said portion of said subject's body, wherein the means for guiding the pulsations, comprise a gelatinous or granular fluid between said outer and inner layers, performing a progressive propagation of each of the pulsations to propagate progressively in the venous return direction along said structure.

2. The device according to claim 1, further comprising means for determining a pulsation frequency as a function of data selected from the group consisting of data relating to heart rate, data relating to breathing rate, data relating to the subject's state of health and, data relating to the body portion on which said multilayer structure is applied.

3. The device according to claim 1, further comprising an opening for filling the cavity with a substance, said opening being closed in leaktight manner by means for sealing said opening.

4. The device according to claim 1, wherein the multilayer structure includes an admission opening for admitting a pulsation fluid coming from the means for pulsating between the inner and outer layers.

5. The device according to claim 4, wherein the gelatinous fluid is contained in an intermediate layer between the outer layer and the inner layer.

6. The device according to claim 1, wherein the means for pulsating comprise:

a pneumatic reservoir;

means for compressing said pneumatic reservoir in rhythmic manner; and a leaktight connector connecting said pneumatic reservoir to the flexible multilayer structure.

7. The device according to claim 1, wherein the means for pulsating comprise:

a pneumatic reservoir; and a leaktight connector connecting said pneumatic reservoir to the flexible multilayer structure;

wherein the pneumatic reservoir, the connector, and the structure constitute a closed circuit for the pulsation fluid; and the pneumatic reservoir is arranged in such a manner as to be compressed and decompressed by a force exerted by said subject.

8. The device according to claim 7, wherein the pneumatic reservoir, the connector, and the flexible multilayer structure constitute a one-piece unit.

9. The device according to claim 1, wherein the flexible multilayer structure comprises a hood for placing over at least a portion of the subject's face.

10. The device according to claim 1, wherein the flexible multilayer structure comprises a pair of trousers.

11. A non-invasive pulsatile circulatory assistance assembly covering a plurality of portions of a subject's body, said assembly comprising at least one device according to claim 1 for each of said portions.

12. A non-invasive pulsatile circulatory assistance assembly covering a plurality of portions of a subject's body, said assembly comprises:

for each of said portions, a flexible multilayer structure for application on said portion of said subject's body, said structure comprising a flexible inner layer beside said subject's body and a more rigid outer layer, wherein the inner layer comprises, on at least one portion thereof, a cavity between a microporous wall for putting into contact with the subject's skin and a wall beside the outer layer, said cavity being arranged to receive or convey a substance for application to said subject's skin through said microporous wall; and means for pulsating common to said pulsatile structures, said means for pulsating being connected in leaktight manner to each of said multilayer structures, and creating pulsations between said inner and outer layers of each of said structures by means of a pulsation fluid;

each of said structures including means for guiding each of said pulsations progressively in the venous return direction towards the inside of said subject's body along said portion of said subject's body when said structure is placed on said portion of said subject's body.

* * * * *